US005754976A

United States Patent [19]

Adoul et al.

[11] Patent Number: 5,754,976

[45] Date of Patent: May 19, 1998

[54] ALGEBRAIC CODEBOOK WITH SIGNAL-SELECTED PULSE AMPLITUDE/POSITION COMBINATIONS FOR FAST CODING OF SPEECH

[75] Inventors: Jean-Pierre Adoul; Claude Laflamme, both of Sherbrooke, Canada

[73] Assignee: Universite de Sherbrooke, Sherbrooke, Canada

[21] Appl. No.: 508,801

[22] Filed: Jul. 28, 1995

Related U.S. Application Data

[63] Continuation-in-part of Ser. No. 383,968, Feb. 6, 1995, abandoned, which is a continuation-in-part of Ser. No. 927,528, filed as PCT/CA90/00381, Nov. 6, 1990, published as WO91/13432, Sep. 5, 1991, Pat. No. 5,444,816.

[30] Foreign Application Priority Data

Feb. 23, 1990 [CA] Canada ..... 2010830

[51] Int. Cl.[6] ..... G10L 5/00

[52] U.S. Cl. ..... 704/223; 704/219; 704/230

[58] Field of Search ..... 395/2.28, 2.32, 395/2.39; 704/219, 223, 230

[56] References Cited

U.S. PATENT DOCUMENTS

| | | | |
|---|---|---|---|
| 4,401,855 | 8/1983 | Broderson et al. | 704/219 |
| 4,486,899 | 12/1984 | Fushikida | 704/217 |
| 4,520,499 | 5/1985 | Montlick et al. | 704/266 |
| 4,594,687 | 6/1986 | Kaneko et al. | 711/220 |
| 4,625,286 | 11/1986 | Papamichalis et al. | 704/219 |
| 4,667,340 | 5/1987 | Arjmand et al. | 704/207 |

(List continued on next page.)

FOREIGN PATENT DOCUMENTS

| | | |
|---|---|---|
| 0 138 061 | 4/1985 | European Pat. Off. . |
| 0 149 724 | 7/1985 | European Pat. Off. . |
| 0 342 687 | 11/1989 | European Pat. Off. . |
| 0 446 817 | 9/1991 | European Pat. Off. . |
| 0 514 912 A3 | 11/1992 | European Pat. Off. . |
| 0 532 225 A2 | 3/1993 | European Pat. Off. . |
| 0 545 386 | 6/1993 | European Pat. Off. . |
| 90/00381 | 11/1990 | WIPO . |
| WO 91/13432 | 9/1991 | WIPO . |

OTHER PUBLICATIONS

Claude Laflamme, Jean-Pierre Adoul, R. Salami, S. Morisette, and P. Mabilleau, "16 Kbps Wideband Speech Coding Technique Based on Algebraic CELP", Proceeding of IEEE ICASSP 91, session S1.4, pp. 13–16, May 1991.

Laflamme, et al., "On Reducing Computational Complexity of Codebook Search in CELP Coder Through the Use of Algebraic Codes", Proceeding of the IEEE ICASSP 1990, pp. 177–180.

(List continued on next page.)

*Primary Examiner*—David R. Hudspeth
*Assistant Examiner*—Tālivaldis Ivars Šmits
*Attorney, Agent, or Firm*—Merchant, Gould, Smith, Edell, Welter & Schmidt

[57] ABSTRACT

A codebook is searched in view of encoding a sound signal. This codebook consists of a set of pulse amplitude/position combinations each defining L different positions and comprising both zero-amplitude pulses and non-zero-amplitude pulses assigned to respective positions p=1, 2, . . . L of the combination, wherein each non-zero-amplitude pulse assumes at least one of q possible amplitudes. To reduce the search complexity, a subset of pulse amplitude/position combinations from the codebook is pre-selected in relation to the sound signal, and only this subset of combinations is searched. The pre-selection of the subset of combinations consists of pre-establishing, in relation to the sound signal, a function $S_p$ between the respective positions p=1, 2, . . . L and the q possible amplitudes, the search being limited to the combinations of the codebook having non-zero-amplitude pulses which respect the pre-established function. The function can be pre-established by pre-assigning one of the q possible amplitudes to each position p, the pre-established function being respected when the non-zero-amplitude pulses of a combination each have an amplitude equal to the amplitude $S_p$ pre-assigned to the position p of that pulse.

27 Claims, 6 Drawing Sheets

U.S. PATENT DOCUMENTS

| | | | |
|---|---|---|---|
| 4,669,120 | 5/1987 | Ono | 704/216 |
| 4,677,671 | 6/1987 | Galand et al. | 704/212 |
| 4,680,797 | 7/1987 | Benke | 704/211 |
| 4,710,959 | 12/1987 | Feldman et al. | 704/207 |
| 4,720,861 | 1/1988 | Bertrand | 704/222 |
| 4,724,535 | 2/1988 | Ono | 375/241 |
| 4,742,550 | 5/1988 | Fette | 704/219 |
| 4,764,963 | 8/1988 | Atal | 704/219 |
| 4,771,465 | 9/1988 | Bronson et al. | 704/207 |
| 4,797,925 | 1/1989 | Lin | 704/223 |
| 4,797,926 | 1/1989 | Bronson et al. | 704/214 |
| 4,799,261 | 1/1989 | Lin et al. | 704/219 |
| 4,811,398 | 3/1989 | Copperi et al. | 704/230 |
| 4,815,134 | 3/1989 | Picone et al. | 704/222 |
| 4,817,157 | 3/1989 | Gerson | 704/230 |
| 4,821,324 | 4/1989 | Ozawa et al. | 704/216 |
| 4,858,115 | 8/1989 | Rusterholz et al. | 395/800.07 |
| 4,860,355 | 8/1989 | Copperi | 704/213 |
| 4,864,620 | 9/1989 | Bialick | 704/207 |
| 4,868,867 | 9/1989 | Davidson et al. | 704/230 |
| 4,873,723 | 10/1989 | Shibagaki et al. | 704/218 |
| 4,964,169 | 10/1990 | Ono | 704/218 |
| 4,991,214 | 2/1991 | Freeman et al. | 704/223 |
| 5,097,508 | 3/1992 | Steude et al. | 704/223 |
| 5,193,140 | 3/1993 | Minde | 704/222 |
| 5,293,449 | 3/1994 | Tzeng | 704/223 |
| 5,307,441 | 4/1994 | Tzeng | 704/222 |
| 5,457,783 | 10/1995 | Chhatwal | 704/219 |

OTHER PUBLICATIONS

Abstract of "Low delay speech coding", Cuperman, et al., Journal Speech Communication, vol. 12, No. 2, Netherlands, Jun. 1993, pp. 193–204.

"8 kbits/s Speech Coder with Pitch Adaptive Vector Quantizer" S. Iai and K. Irie, ICASSP 1986, Tokyo, vol. 3, Apr. 1986, pp. 1697–1700.

"Fast Methods for Code Search in CELP" M.E. Ahmed and M.I. Al–Suwaiyel, IEEE Transactions on Speech and Audio Processing, 1993, vol. 1, No. 3, New York, pp. 315–325.

"Algorithme de quantification vectorielle sphérique à partir du réseau de Gosset d'ordre 8" C. Lamblin et J.P. Adoul, Annales es Télécommunications, 1988, vol. 43, No. 1–2, pp. 172–186.

"A robust 16 Kbits/s vector adaptive predictive coder for mobile communications" A. Le Guyader et al. ICASSP 86 Prooceedings, Apr. 7–11, Tokyo, Japan pp. 857–860.

"A comparision of some alegbraic structures for CELP coding of speech" J–P. Adoul et al. ICASSP 87 Proceedings, Apr. 6–9, 1987, Dallas, Texas pp. 1953–1956.

"Fast CELP coding based on algebraic codes" J–P. Adoul et al. ICASSP 87 Proceedings Apr. 6–9, 1987, Dallas Texas pp. 1957–1960.

"Multipulse excitation codebook design and fast search methods for CELP speech coding" F.F. Tzeng IEEE Glob. Telcom. Conf. & Exhib., Nov. 28–Dec. 1, 1988 Hollywood Fla, pp. 0590–0594.

"Coding of Speech at 8 kbit/s using Conjugate–structure Algebraic–code–excited Linear–Predictive (CS–ACELP) Coding" Study Group 15 contrib., Int. Telecom. Union Jun. 1995, pp. 1–43.

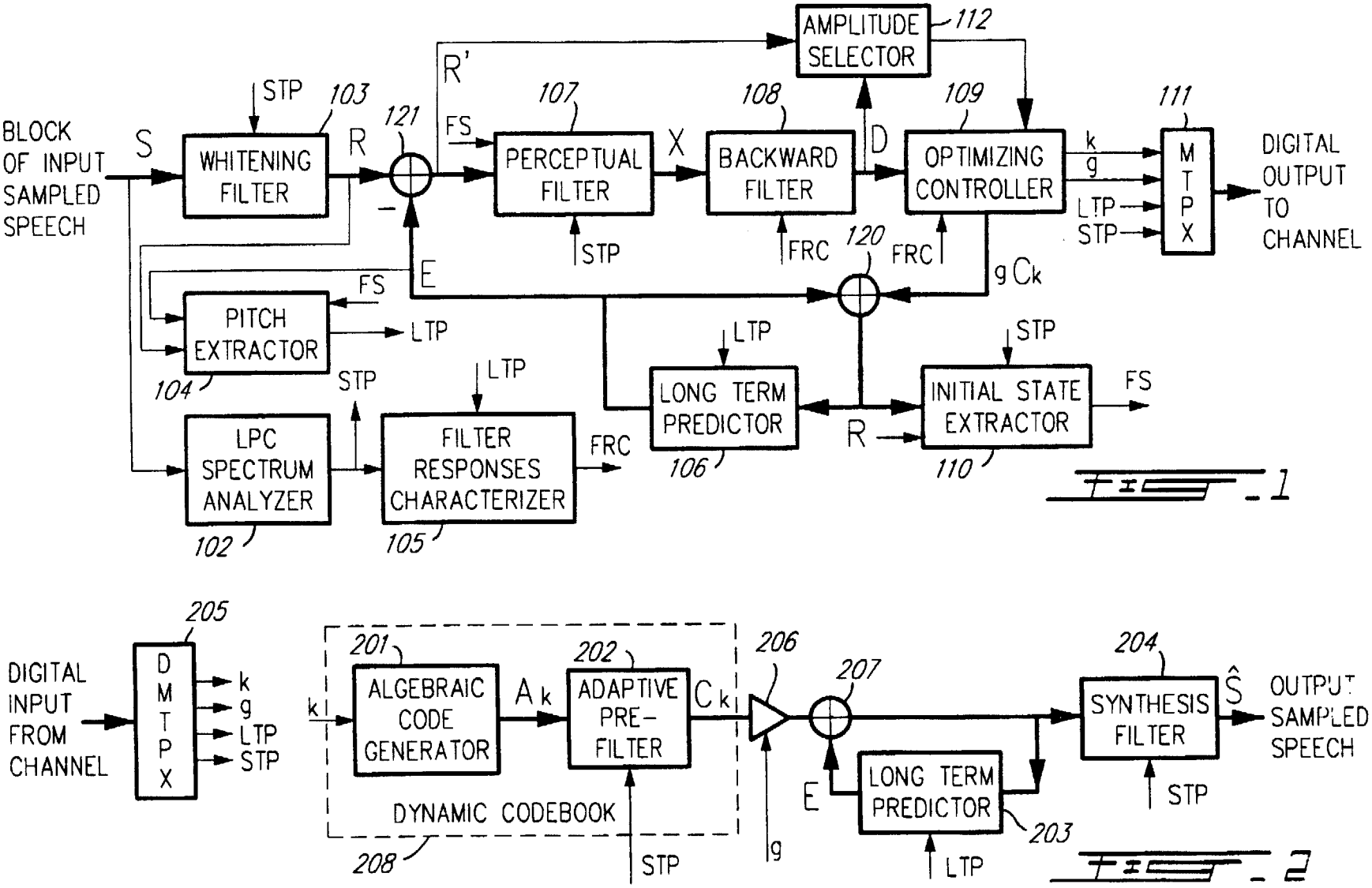
BLOCK OF INPUT SAMPLED SPEECH
S
WHITENING FILTER
103
STP
R
121
R'
FS
PERCEPTUAL FILTER
107
STP
X
BACKWARD FILTER
108
FRC
D
AMPLITUDE SELECTOR
112
OPTIMIZING CONTROLLER
109
k
g
LTP
STP
MTPX
111
DIGITAL OUTPUT TO CHANNEL
E
FS
PITCH EXTRACTOR
104
LTP
STP
LPC SPECTRUM ANALYZER
102
FILTER RESPONSES CHARACTERIZER
105
FRC
LTP
LONG TERM PREDICTOR
106
LTP
120
FRC
g Ck
R
INITIAL STATE EXTRACTOR
110
STP
FS
1
DIGITAL INPUT FROM CHANNEL
DMTPX
205
k
g
LTP
STP
k
ALGEBRAIC CODE GENERATOR
201
Ak
ADAPTIVE PRE-FILTER
202
STP
Ck
DYNAMIC CODEBOOK
208
206
g
207
E
LONG TERM PREDICTOR
203
LTP
SYNTHESIS FILTER
204
STP
Ŝ
OUTPUT SAMPLED SPEECH
2

ALGEBRAIC CODEBOOK WITH SIGNAL-SELECTED PULSE AMPLITUDE/POSITION COMBINATIONS FOR FAST CODING OF SPEECH

RELATED U.S. PATENT APPLICATION

This is a Continuation-In-Part of U.S. patent application Ser. No. 08/383,968 filed on Feb. 6, 1995, now abandoned, which is a continuation-in part application of a patent application, Ser. No. 07/927,528, filed as PCT/CA90/00381, Nov. 6, 1990, published as WO91/13432, Sep. 5, 1991, now issued as U.S. Pat. No. 5,444,816, issued Aug. 22, 1995 for an invention entitled "ALGEBRAIC CODEBOOK WITH SIGNAL-SELECTED PULSE AMPLITUDES FOR FAST CODING OF SPEECH".

BACKGROUND OF THE INVENTION

1. Field of the Invention

The present invention relates to an improved technique for digitally encoding a sound signal, in particular but not exclusively a speech signal, in view of transmitting and synthesizing this sound signal.

2. Brief Description of the Prior Art

The demand for efficient digital speech encoding techniques with a good subjective quality/bit rate tradeoff is increasing for numerous applications such as voice transmission over satellites, land mobile, digital radio or packed network, voice storage, voice response and wireless telephony.

One of the best prior art techniques capable of achieving a good quality/bit rate tradeoff is the so called Code Excited Linear Prediction (CELP) technique. According to this technique, the speech signal is sampled and processed in blocks of L samples (i.e. vectors), where L is some predetermined number. The CELP technique makes use of a codebook.

A codebook, in the CELP context, is an indexed set of L-sample-long sequences which will be referred to as L-dimensional codevectors (pulse combinations defining L different positions and comprising both zero-amplitude pulses and non-zero-amplitude pulses assigned to respective positions p=1, 2, . . . L of the combination). The codebook comprises an index k ranging from 1 to M, where M represents the size of the codebook sometimes expressed as a number of bits b:

$$M=2^b$$

A codebook can be stored in a physical memory (e.g. a look-up table), or can refer to a mechanism for relating the index to a corresponding codevector (e.g. a formula).

To synthesize speech according to the CELP technique, each block of speech samples is synthesized by filtering the appropriate codevector from the codebook through time varying filters modelling the spectral characteristics of the speech signal. At the encoder end, the synthetic output is computed for all or a subset of the candidate codevectors from the codebook (codebook search). The retained codevector is the one producing the synthetic output which is the closest to the original speech signal according to a perceptually weighted distortion measure.

A first type of codebooks are the so called "stochastic" codebooks. A drawback of these codebooks is that they often involve substantial physical storage. They are stochastic, i.e. random in the sense that the path from the index to the associated codevector involves look-up tables which are the result of randomly generated numbers or statistical techniques applied to large speech training sets. The size of stochastic codebooks tends to be limited by storage and/or search complexity.

A second type of codebooks are the algebraic codebooks. By contrast with the stochastic codebooks, algebraic codebooks are not random and require no storage. An algebraic codebook is a set of indexed codevectors in which the amplitudes and positions of the pulses of the $k^{th}$ codevector can be derived from its index k through a rule requiring no, or minimal, physical storage. Therefore, the size of an algebraic codebook is not limited by storage requirements. Algebraic codebooks can also be designed for efficient search.

OBJECTS OF THE INVENTION

An object of the present invention is therefore to provide a method and device for drastically reducing the complexity of the codebook search upon encoding an sound signal, these method and device being applicable to a large class of codebooks.

Another object of the present invention is a method and device capable of selecting a-priori a subset of the codebook pulse combinations and restraining the combinations to be searched to this subset in view of reducing the codebook search complexity.

A further object of the present invention is to increase the size of a codebook by allowing the individual non-zero-amplitude pulses of the codevectors to assume at least one of q possible amplitudes without increasing the search complexity.

SUMMARY OF THE INVENTION

More particularly, in accordance with the present invention, there is provided a method of conducting a search in a codebook in view of encoding a sound signal, the codebook consisting of a set of pulse combinations and each pulse combination defining a plurality of different positions and comprising pulses assigned to respective positions of the combination, this method comprising the steps of:

pre-selecting from the codebook a subset of pulse combinations in relation to the sound signal; and searching only the subset of pulse combinations in view of encoding the sound signal;

whereby, in operation, complexity of the search is reduced as only a subset of the pulse combinations of the codebook is searched.

The present invention also relates to a method of conducting a search in a codebook in view of encoding a sound signal, in which the codebook consists of a set of pulse amplitude/position combinations, each pulse amplitude/position combination defines L different positions and comprising both zero-amplitude pulses and non-zero-amplitude pulses assigned to respective positions p=1, 2, . . . L of the combination, and each non-zero-amplitude pulses assumes at least one of q possible amplitudes. This method comprises the steps of:

pre-selecting from the codebook a subset of pulse amplitude/position combinations in relation to the sound signal; and searching only the subset of pulse amplitude/position combinations in view of encoding the sound signal.

Again, complexity of the search is reduced as only a subset of the pulse amplitude/position combinations of the codebook is searched.

Still in accordance with the present invention, there is provided a device for conducting a search in a codebook in view of encoding a sound signal, the codebook consisting of a set of pulse combinations and each pulse combination defining a plurality of different positions and comprising pulses assigned to respective positions of the combination, the device comprising:

means for pre-selecting from the codebook a subset of pulse combinations in relation to the sound signal; and means for searching only the subset of pulse combinations in view of encoding the sound signal.

In operation, complexity of the search is reduced as only a subset of the pulse combinations of the codebook is searched.

The subject invention further relates to a device for conducting a search in a codebook in view of encoding a sound signal, the codebook consisting of a set of pulse amplitude/position combinations, each pulse amplitude/position combination defining L different positions and comprising both zero-amplitude pulses and non-zero-amplitude pulses assigned to respective positions p=1, 2, . . . L of the combination, and each non-zero-amplitude pulses assuming at least one of q possible amplitudes. This device comprises means for pre-selecting from the codebook a subset of pulse amplitude/position combinations in relation to the sound signal, and means for searching only the subset of pulse amplitude/position combinations in view of encoding the sound signal, whereby complexity of the search is reduced as only a subset of the pulse amplitude/position combinations of the codebook is searched.

Still further in accordance with the present invention, there is provided a cellular communication system for servicing a large geographical area divided into a plurality of cells, comprising:

mobile portable transmitter/receiver units;

cellular base stations respectively situated in the cells;

means for controlling communication between the cellular base stations;

a bidirectional wireless communication sub-system between each mobile unit situated in one cell and the cellular base station of the one cell, the bidirectional wireless communication sub-system comprising in both the mobile unit and the cellular base station (a) a transmitter including means for encoding a speech signal and means for transmitting the encoded speech signal, and (b) a receiver including means for receiving a transmitted encoded speech signal and means for decoding the received encoded speech signal;

wherein the speech signal encoding means comprises a device for conducting a search in a codebook in view of encoding the speech signal, the codebook consisting of a set of pulse combinations and each pulse combination defining a plurality of different positions and comprising pulses assigned to respective positions of the combination, the search conducting device comprising:

means for pre-selecting from the codebook a subset of pulse combinations in relation to the speech signal; and means for searching only the subset of pulse combinations in view of encoding the speech signal;

In operation, complexity of the search is still reduced as only a subset of the pulse combinations of the codebook is searched.

Finally, the present invention is concerned with a cellular communication system for servicing a large geographical area divided into a plurality of cells, comprising:

mobile portable transmitter/receiver units;

cellular base stations respectively situated in the cells;

means for controlling communication between the cellular base stations;

a bidirectional wireless communication sub-system between each mobile unit situated in one cell and the cellular base station of the one cell, the bidirectional wireless communication sub-system comprising in both the mobile unit and the cellular base station (a) a transmitter including means for encoding a speech signal and means for transmitting the encoded speech signal, and (b) a receiver including means for receiving a transmitted encoded speech signal and means for decoding the received encoded speech signal;

wherein the speech signal encoding means comprises a device for conducting a search in a codebook in view of encoding the speech signal, the codebook consisting of a set of pulse amplitude/position combinations, each pulse amplitude/position combination defining L different positions and comprising both zero-amplitude pulses and non-zero-amplitude pulses assigned to respective positions p=1, 2, . . . L of the combination, and each non-zero-amplitude pulses assuming at least one of q possible amplitudes, the search conducting device comprising:

means for pre-selecting from the codebook a subset of pulse amplitude/position combinations in relation to the speech signal; and means for searching only the subset of pulse amplitude/position combinations in view of encoding the speech signal.

In operation, complexity of the search is reduced as only a subset of the pulse amplitude/position combinations of the codebook is searched.

In accordance with a preferred embodiment of the invention, (a) the subset of pulse amplitude/position combinations is pre-selecting by pre-establishing, in relation to the sound signal, a function $S_p$ between the respective positions p=1, 2, . . . L and the q possible amplitudes, and (b) only the pulse amplitude/position combinations of the codebook having non-zero-amplitude pulses which respect the pre-established function are searched.

Advantageously, the function $S_p$ is pre-established by pre-assigning, in relation to the sound signal, one of the q possible amplitudes to each position p, and the pre-established function is respected when the non-zero-amplitude pulses of a pulse amplitude/position combination each have an amplitude equal to the amplitude $S_p$ pre-assigned to the position p of the non-zero-amplitude pulse.

Preferably, pre-assigning one of the q possible amplitudes to each position p comprises the steps of:

processing the sound signal to produce a backward-filtered target signal D and a pitch-removed residual signal R';

calculating an amplitude estimate vector B in response to the backward-filtered target signal D and to the pitch-removed residual signal R'; and for each of the positions p, quantizing an amplitude estimate $B_p$ of the vector B to obtain the amplitude to be selected for the position p.

Calculation of the amplitude estimate vector B advantageously comprises the step of summing the backward-filtered target signal D in normalized form:

$$(1-\beta)\frac{D}{\|D\|}$$

to the pitch-removed residual signal R' in normalized form:

$$\beta \frac{R'}{\|R'\|}$$

to thereby obtain an amplitude estimate vector B of the form:

$$B = (1-\beta)\frac{D}{\|D\|} + \beta\frac{R'}{\|R'\|}$$

where β is a fixed constant preferably having a value situated between 0 and 1.

According to a further preferred embodiment of the subject invention, quantizing is performed on a peak-normalized amplitude estimate $B_p$ of the vector B using the following expression:

$$B_p/\max_n |B_n|$$

wherein the denominator $$\max_n |B_n|$$

is a normalizing factor representing a peak amplitude of the non-zero-amplitude pulses.

The pulse combinations may each comprise a number N of non-zero-amplitude pulses, and the positions p of the non-zero-amplitude pulses are advantageously restrained in accordance with at least one N-interleaved single-pulse permutation code.

Searching the codebook preferably comprises maximizing a given ratio having a denominator $\alpha_k^2$ computed by means of N nested loops in accordance with the following relation:

$$\begin{aligned}\alpha_k^2 = {} & U'(p_1, p_1) + \\ & U'(p_2, p_2) + 2U'(p_1, p_1) + \\ & U'(p_3, p_3) + 2U'(p_1, p_3) + 2U'(p_2, p_3) + \\ & \cdot \\ & \cdot \\ & \cdot \\ & U'(p_N, p_N) + 2U'(p_1, p_N) + 2U'(p_2, p_N) + \ldots + 2U'(p_{N-1}, p_N)\end{aligned}$$

where computation for each loop is written in a separate line from an outermost loop to an innermost loop of the N nested loops, where $p_n$ is the position of the $n^{th}$ non-zero-amplitude pulse of the combination, and where U' ($p_x$, $p_y$) is a function dependent on the amplitude $S_{p_x}$ pre-assigned to a position $p_x$ amongst the positions p and the amplitude $S_{p_y}$ pre-assigned to a position $p_y$ amongst the positions p. In the above calculation, at least the innermost loop of the N nested loops may be skipped whenever the following inequality is true $$\sum_{n=1}^{N-1} S_{p_n} D_{p_n} < T_D$$

where $S_{p_n}$ is the amplitude pre-assigned to position $p_n$, $D_{p_n}$ is the $p_n^{th}$ component of the target vector D, and $T_D$ is a threshold related to the backward-filtered target vector D.

The objects, advantages and other features of the present invention will become more apparent upon reading of the following non restrictive description of a preferred embodiment thereof, given by way of example only with reference to the accompanying drawings.

BRIEF DESCRIPTION OF THE DRAWINGS

In the appended drawings:

FIG. 1 is a schematic block diagram of a sound signal encoding device comprising an amplitude selector and an optimizing controller in accordance with the present invention;

FIG. 2 is a schematic block diagram of a decoding device associated with the encoding device of FIG. 1;

DETAILED DESCRIPTION OF THE PREFERRED EMBODIMENT

Figure 5:
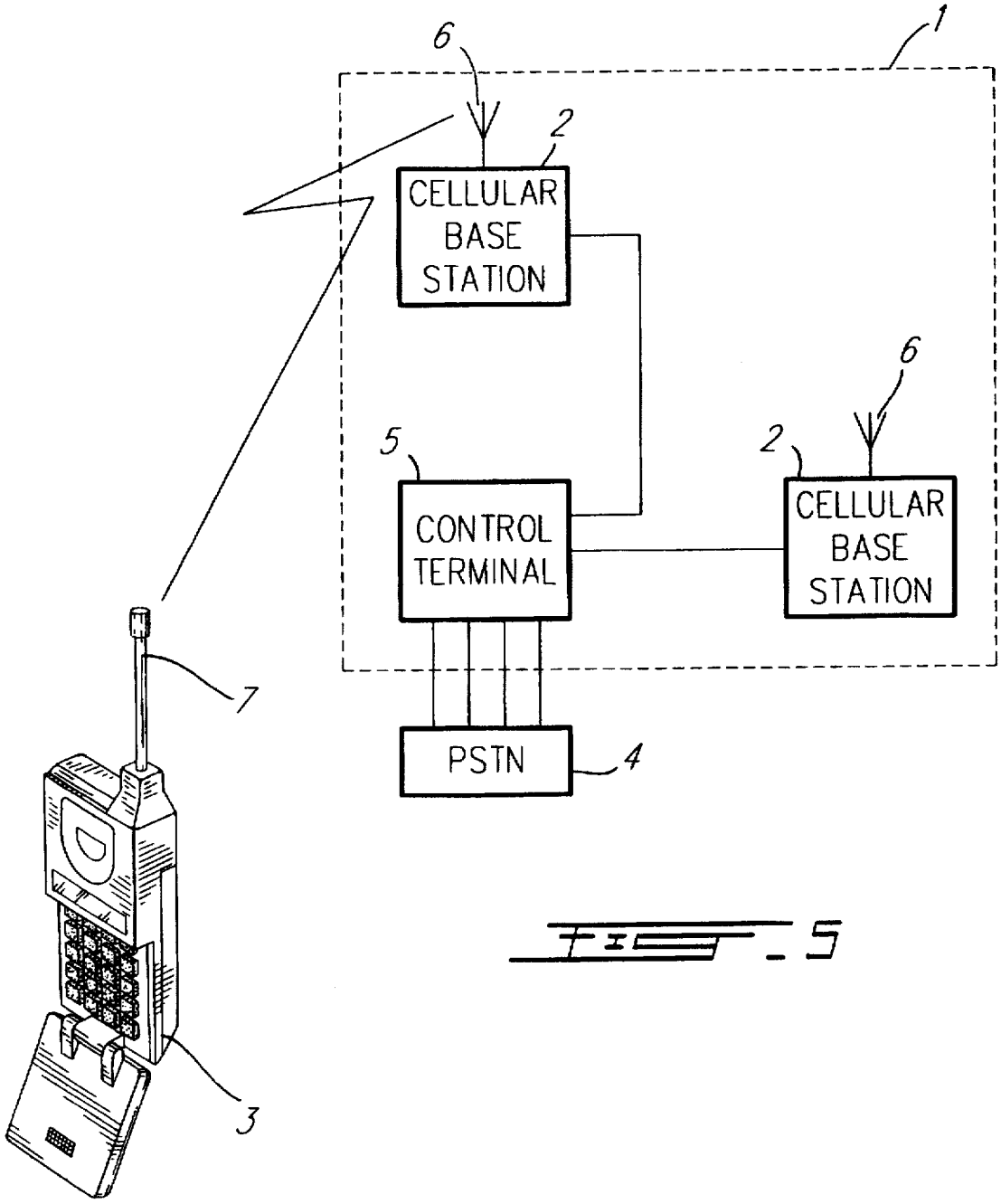
FIG. 5 is a schematic block diagram illustrating the infrastructure of a typical cellular communication system.

FIG. 5 illustrates the infrastructure of a typical cellular communication system 1.

Although application of the search conducting method and device according to the invention to a cellular communication system is disclosed as a non limitative example in the present specification, it should be kept in mind that these method and device can be used with the same advantages in many other types of communication systems in which sound signal encoding is required.

In a cellular communication system such as 1, a telecommunications service is provided over a large geographic area by dividing that large area into a number of smaller cells. Each cell has a cellular base station 2 (FIG. 5) for providing radio signalling channels, and audio and data channels.

The radio signalling channels are utilized to page mobile radio telephones (mobile transmitter/receiver units) such as 3 within the limits of the cellular base station's coverage area (cell), and to place calls to other radio telephones either inside or outside the base station's cell, or onto another network such as the Public Switched Telephone Network (PSTN) 4.

Once a radio telephone 3 has successfully placed or received a call, an audio or data channel is set up with the cellular base station 2 corresponding to the cell in which the radio telephone 3 is situated, and communication between the base station 2 and radio telephone 3 occurs over that audio or data channel. The radio telephone 3 may also receive control or timing information over the signalling channel whilst a call is in progress.

If a radio telephone 3 leaves a cell during a call and enters another cell, the radio telephone hands over the call to an available audio or data channel in the new cell. Similarly, if no call is in progress a control message is sent over the signalling channel such that the radio telephone logs onto the base station 2 associated with the new cell. In this manner mobile communication over a wide geographical area is possible.

The cellular communication system 1 further comprises a terminal 5 to control communication between the cellular base stations 2 and the Public Switched Telephone Network 4, for example during a communication between a radio telephone 3 and the PSTN 4, or between a radio telephone 3 in a first cell and a radio telephone 3 in a second cell.

Of course, a bidirectional wireless radio communication sub-system is required to establish communication between each radio telephone 3 situated in one cell and the cellular base station 2 of that cell. Such a bidirectional wireless radio communication system typically comprises in both the radio telephone 3 and the cellular base station 2 (a) a transmitter for encoding the speech signal and for transmitting the encoded speech signal through an antenna such as 6 or 7, and (b) a receiver for receiving a transmitted encoded speech signal through the same antenna 6 or 7 and for decoding the received encoded speech signal. As well known to those of ordinary skill in the art, voice encoding is required in order to reduce the bandwidth necessary to transmit speech across the bidirectional wireless radio communication system, i.e. between a radio telephone 3 and a base station 2.

The aim of the present invention is to provide an efficient digital speech encoding technique with a good subjective quality/bit rate tradeoff for example for bidirectional transmission of speech signals between a cellular base station 2 and a radio telephone 3 through an audio or data channel. FIG. 1 is a schematic block diagram of a digital speech encoding device suitable for carrying out this efficient technique.

The speech encoding device of FIG. 1 is the same encoding device as illustrated in FIG. 1 of U.S. parent patent application Ser. No. 07/927,528 to which an amplitude selector 112 in accordance with the present invention has been added. U.S. parent patent application Ser. No. 07/927,528 was filed on Sep. 10, 1992 for an invention entitled "DYNAMIC CODEBOOK FOR EFFICIENT SPEECH CODING BASED ON ALGEBRAIC CODES".

The analog speech signal is sampled and block processed. It should be understood that the present invention is not limited to an application to speech signal. Encoding of other types of sound signal can also be contemplated.

In the illustrated example, the block of input sampled speech S (FIG. 1) comprises L consecutive samples. In the CELP literature, L is designated as the "subframe" length and is typically situated between 20 and 80. Also, the blocks of L samples are referred to as L-dimensional vectors. Various L-dimensional vectors are produced in the course of the encoding procedure. A list of these vectors which appear in FIGS. 1 and 2, as well as a list of transmitted parameters is given hereinbelow:

| List of the main L-dimensional vectors: | |
|---|---|
| S | Input speech vector; |
| R' | Pitch-removed residual vector; |
| X | Target vector; |
| D | Backward-filtered target vector; |
| $A_k$ | Codevector of index k from the algebraic codebook; and |
| $C_k$ | Innovation vector (filtered codevector). |
| **List of transmitted parameters:** | |
| k | Codevector index (input of the algebraic codebook); |
| g | Gain; |

-continued

| | |
|---|---|
| STP | Short term prediction parameters (defining A(z)); and |
| LTP | Long term prediction parameters (defining a pitch gain b and a pitch delay T). |

DECODING PRINCIPLE

It is believed preferable to describe first the speech decoding device of FIG. 2 illustrating the various steps carried out between the digital input (input of demultiplexer 205) and the output sampled speech (output of synthesis filter 204).

The demultiplexer 205 extracts four different parameters from the binary information received from a digital input channel, namely the index k, the gain g, the short term prediction parameters STP, and the long term prediction parameters LTP. The current L-dimensional vector S of speech signal is synthesized on the basis of these four parameters as will be explained in the following description.

The speech decoding device of FIG. 2 comprises a dynamic codebook 208 composed of an algebraic code generator 201 and an adaptive prefilter 202, an amplifier 206, an adder 207, a long term predictor 203, and a synthesis filter 204.

In a first step, the algebraic code generator 201 produces a codevector $A_k$ in response to the index k.

In a second step, the codevector $A_k$ is processed by an adaptive prefilter 202 supplied with the long term prediction parameters LTP to produce an output innovation vector $C_k$. The purpose of the adaptive prefilter 202 is to dynamically control the frequency content of the output innovation vector $C_k$ so as to enhance speech quality, i.e. to reduce the audible distortion caused by frequencies annoying the human ear. Typical transfer functions F(z) for the adaptive prefilter 202 are given below:

$$F_a(z) = \left( \frac{A(z/\gamma_1)}{A(z/\gamma_2)} \right)$$

$$F_b(z) = \frac{1}{(1 - b_0 z^T)}$$

$F_a(z)$ is a formant prefilter in which $0<\gamma_1<\gamma_2<1$ are constants. This prefilter enhances the formant regions and works very effectively specially at coding rate below 5 kbit/s.

$F_b(z)$ is a pitch prefilter where T is the time varying pitch delay and $b_0$ is either constant or equal to the quantized long term pitch prediction parameter from the current or previous subframes. $F_b(z)$ is very effective to enhance pitch harmonic frequencies at all rates. Therefore, F(z) typically includes a pitch prefilter sometimes combined with a formant prefilter, namely:

$$F(z)=F_a(z)\,F_b(z)$$

In accordance with the CELP technique, the output sampled speech signal $\hat{S}$ is obtained by first scaling the innovation vector $C_k$ from the codebook 208 by the gain g through the amplifier 206. The adder 207 then adds the scaled waveform $gC_k$ to the output E (the long term prediction component of the signal excitation of the synthesis filter 204) of a long term predictor 203 supplied with the LTP parameters, placed in a feedback loop and having a transfer function B(z) defined as follows:

$$B(z)=bz^{-T}$$

where b and T are the above defined pitch gain and delay, respectively.

The predictor 203 is a filter having a transfer function being in accordance with the last received LTP parameters b and T to model the pitch periodicity of speech. It introduces the appropriate pitch gain b and delay T of samples. The composite signal $E+gC_k$ constitutes the signal excitation of the synthesis filter 204 which has a transfer function 1/A(z) (A(z) being defined in the following description). The filter 204 provides the correct spectrum shaping in accordance with the last received STP parameters. More specifically, the filter 204 models the resonant frequencies (formants) of speech. The output block $\hat{S}$ is the synthesized sampled speech signal which can be converted into an analog signal with proper anti-aliasing filtering in accordance with a technique well known in the art.

There are many ways to design an algebraic code generator 201. An advantageous method, disclosed in the above mentioned U.S. patent application Ser. No. 07/927,528, consists of using at least one N-interleaved single-pulse permutation code.

This concept will be illustrated by way of a simple algebraic code generator 201. In this example, L=40 and the set of 40-dimensional codevectors contains only N=5 non-zero-amplitude pulses that will be called $S_{p_1}$, $S_{p_2}$, $S_{p_3}$, $S_{p_4}$, $S_{p_5}$. In this more thorough notation, $p_i$ stands for the location of the $i^{th}$ pulse within the subframe (i.e., $p_i$ ranges from 0 to L−1). Suppose that pulse $S_{p_1}$ is constrained to eight possible positions $p_1$ as follows:

$$p_1=0,5,10,15,20,25,30,35=0+8m_1;\ m_1=0,1\ldots 7$$

Within these eight positions, which can be called "track"#1, $S_{p_1}$ and seven zero-amplitude pulses can freely permute. This is a "single-pulse permutation code". Let us now interleave five such "single pulse permutation codes" by also constraining the positions of the remaining pulses in a similar fashion (i.e. track #2, track #3, track #4, and track #5).

$$p_1=0,5,10,15,20,25,30,35=0+8m_1$$

$$p_2=1,6,11,16,21,26,31,36=1+8m_2$$

$$p_3=2,7,12,17,22,27,32,37=2+8m_3$$

$$p_4=3,8,13,18,23,28,33,38=3+8m_4$$

$$p_5=4,9,14,19,24,29,34,39=4+8m_5$$

Note that the integers $m_i$=0, 1, . . ., 7 fully define the position $p_i$ of each pulse $S_{p_i}$. Thus, a simple position index $k_p$ can be derived through straightforward multiplexing of the $m_i$'s using the following relation:

$$k_p=4096\ m_1+512\ m_2+64\ m_3+8\ m_4+m_5$$

It should be pointed out that other codebooks can be derived using the above pulse tracks. For instance, only 4 pulses can be used, where the first three pulses occupy the positions in the first three tracks, respectively, while the fourth pulse occupies either the fourth or the fifth track with one bit to specify which track. This design gives rise to a 13 bit position codebook.

In the prior art, the non-zero-amplitude pulses were assumed to have a fixed amplitude for all practical purposes for reasons of codevector search complexity. Indeed, if pulse $S_{p_i}$ may assume one of q possible amplitudes, as many as $q^N$ pulse-amplitude combinations will have to be considered in the search. For instance, if the five pulses of the first example are allowed to take one of q=4 possible amplitudes, for example $S_{p_i}$=+1, −1, +2, −2 instead of a fixed amplitude, the algebraic codebook size jumps from 15 to 15+(5×2) bits=25 bits; that is, a search a thousand time more complex.

It is the purpose of the present invention to disclose the surprising fact that very good performance can be achieved with q-amplitude pulses without paying a heavy price. The solution consists of limiting the search to a restrained subset of codevectors. The method of selecting the codevectors is related to the input speech signal as will be described in the following description.

The practical benefit of the present invention is to enable an increase of the size of the dynamic algebraic codebook 208 by allowing individual pulses to assume different possible amplitudes without increasing the codevector search complexity.

ENCODING PRINCIPLE

The sampled speech signal S is encoded on a block by block basis by the encoding system of FIG. 1 which is broken down into 11 modules numbered from 102 to 112. The function and operation of most of these modules are unchanged with respect to the description of U.S. parent patent application Ser. No. 07/927,528. Therefore, although the following description will at least briefly explain the function and operation of each module, it will concentrate on the matter which is new with respect to the disclosure of U.S. parent patent application Ser. No. 07/927,528.

For each block of L samples of speech signal, a set of Linear Predictive Coding (LPC) parameters, called short term prediction (STP) parameters, is produced in accordance with a prior art technique through an LPC spectrum analyser 102. More specifically, the analyser 102 models the spectral characteristics of each block S of L samples.

The input block S of L-sample is whitened by a whitening filter 103 having the following transfer function based on the current values of the STP parameters:

$$A(z)=\sum_{i=0}^{M} a_i z^{-1}$$

where $a_0$=1, and z is the usual variable of the so-called z-transform. As illustrated in FIG. 1, the whitening filter 103 produces a residual vector R.

A pitch extractor 104 is used to compute and quantize the LTP parameters, namely the pitch delay T and the pitch gain g. The initial state of the extractor 104 is also set to a value FS from an initial state extractor 110. A detailed procedure for computing and quantizing the LTP parameters is described in U.S. parent patent application Ser. No. 07/927,528 and is believed to be well known to those of ordinary skill in the art. Accordingly, it will not be further described in the present disclosure.

A filter responses characterizer 105 (FIG. 1) is supplied with the STP and LTP parameters to compute a filter responses characterization FRC for use in the later steps. The FRC information consists of the following three components where n=1, 2, . . . L.

- $f(n)$: response of $F(z)$

Note that $F(z)$ typically includes the pitch prefilter.

-continued

• $h(n)$: response of $\frac{1}{A(z\gamma^{-1})}$ to $f(n)$ where $\gamma$ is a perceptual factor. More generally, $h(n)$ is the impulse response of $F(z)W(z)/A(z)$ which is the cascade of prefilter $F(z)$, perceptual weighting filter $W(z)$ and synthesis filter $1/A(z)$. Note that $F(z)$ and $1/A(z)$ are the same filters as used in the decoder of Figure 2.

• $U(i,j)$: autocorrelation of $h(n)$ according to the following expression:

$$u(i,j) = \sum_{K=1}^{L} h(k-i+1)h(k-j+1)$$

for $1 \leqq i \leqq L$ and $i \leqq j \leqq L$; $h(n) = 0$ for $n < 1$

The long term predictor 106 is supplied with the past excitation signal (i.e. $E+gC_k$ of the previous subframe) for form the new E component using proper pitch delay T and gain b.

The initial state of the perceptual filter 107 is set to the value FS supplied from the initial state extractor 110. The pitch removed residual vector R'=R−E calculated by a subtractor 121 (FIG. 1) is then supplied to the perceptual filter 107 to obtain at the output of the latter filter a target vector X. As illustrated in FIG. 1, the STP parameters are applied to the filter 107 to vary its transfer function in relation to these parameters. Basically, X=R'−P where P represents the contribution of the long term prediction (LTP) including "ringing" from the past excitations. The MSE criterion which applies to Δ can now be stated in the following matrix notations:

$$\begin{aligned}\min_k \|\Delta\|^2 &= \min_k \|S' - \hat{S}'\|^2 = \min \|S' - [P - gA_kH^T]\|^2 \\ &= \min_k \|X - gA_kH^T\|^2\end{aligned}$$

where H is an L×L lower-triangular Toeplitz matrix formed from the h(n) response as follows. The term h(0) occupies the matrix diagonal and h(1), h(2), . . . h(L−1) occupy the respective lower diagonals.

A backward filtering step is performed by the filter 108 of FIG. 1. Setting to zero the derivative of the above equation with respect to the gain g yields to the optimum gain as follows:

$$\frac{\partial \|\Delta\|^2}{\partial g} = 0$$

$$g = \frac{X(A_kH^T)^T}{\|A_kH^T\|^2}$$

With this value for g, the minimization becomes:

$$\min_k \|\Delta\|^2 = \min_k \left\{ \|X\|^2 - \frac{(X(A_kH^T)^T)^2}{\|A_kH^T\|^2} \right\}$$

The objective is to find the particular index k for which the minimization is achieved. Note that because $\|X\|^2$ is a fixed quantity, the same index can be found by maximizing the following quantity:

$$\max_k \frac{(X(A_kH^T)^T)^2}{\|A_kH^T\|^2} = \max_k \frac{((XH)A_k^T)^2}{\alpha_k^2} = \max_k \frac{(DA_k^T)^2}{\alpha_k^2}$$

where D=(XH) and $\alpha_k^2 = \|A_kH^T\|^2$.

In the backward filter 108, a backward filtered target vector D=(XH) is computed. The term "backward filtering" for this operation comes from the interpretation of (XH) as the filtering of time-reversed X.

Only an amplitude selector 112 has been added to FIG. 1 of the above mentioned U.S. parent patent application Ser. No. 07/927,528. The function of the amplitude selector 112 is to restrain the codevectors $A_k$ being searched by the optimizing controller 109 to the most promising codevectors $A_k$ to thereby reduce the codevector search complexity. As described in the foregoing description, each codevector $A_k$ is a pulse amplitude/position combination waveform defining L different positions p and comprising both zero-amplitude pulses and non-zero-amplitude pulses assigned to respective positions p=1, 2, . . . L of the combination, wherein each non-zero-amplitude pulse assumes at least one of q different possible amplitudes.

Figure 3A:
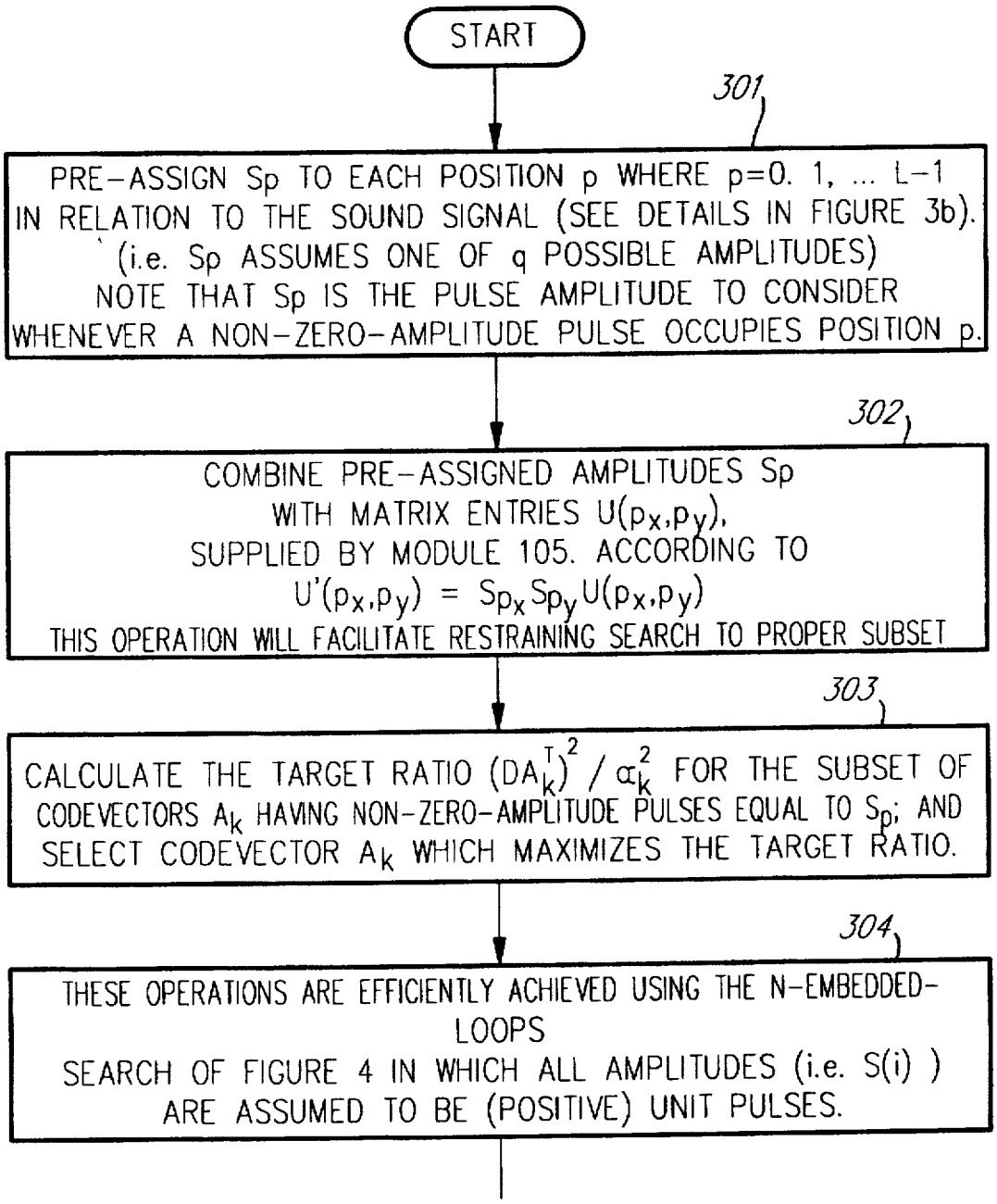
FIG. 3*a* is a sequence of basic operations for the fast codebook search in accordance with the present invention, based on signal-selected pulse amplitudes.
Figure 3B:
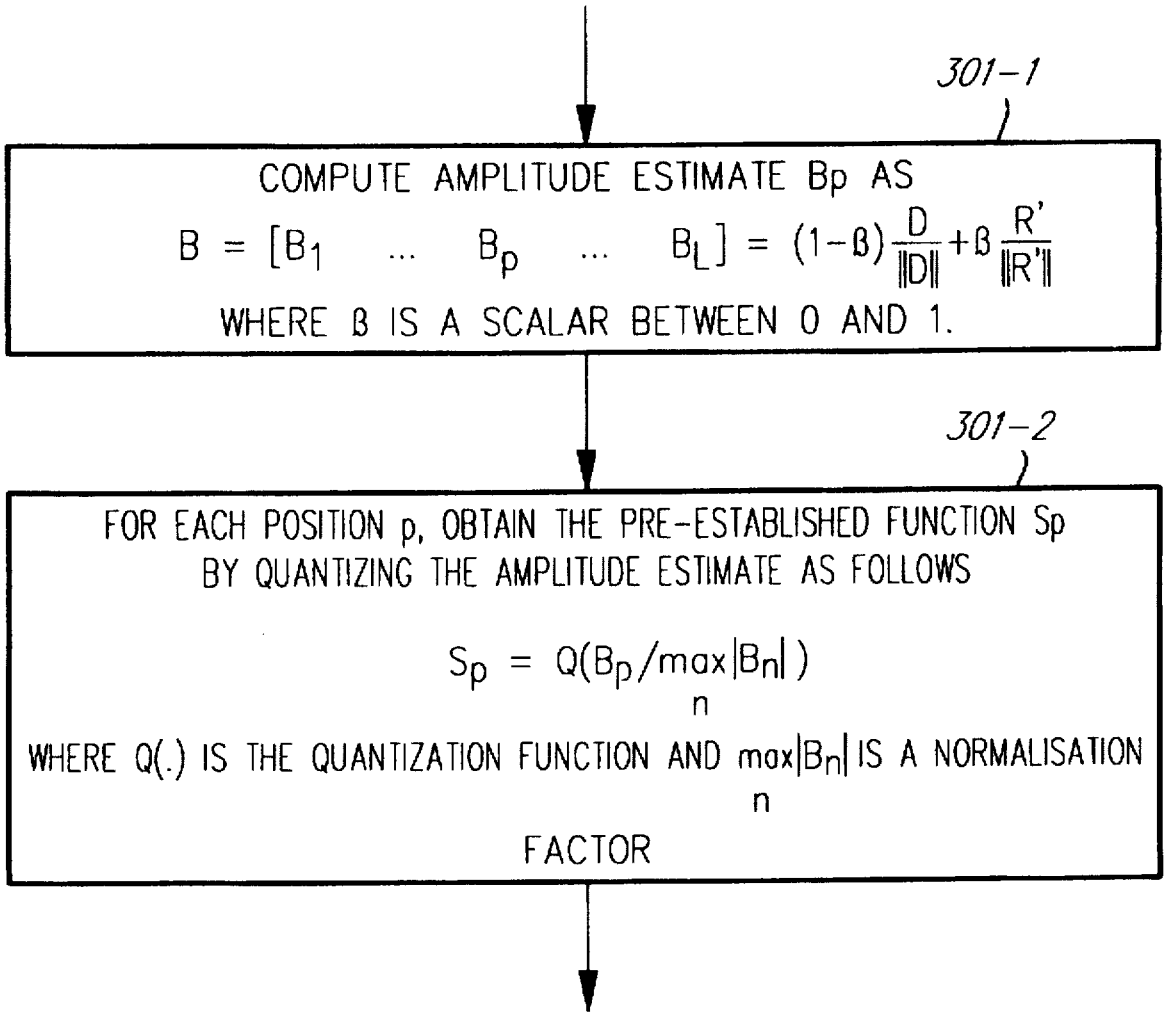
FIG. 3*b* is a sequence of operations for pre-assigning one of the q amplitudes to each position p of the pulse amplitude/position combinations.
Figure 3C:
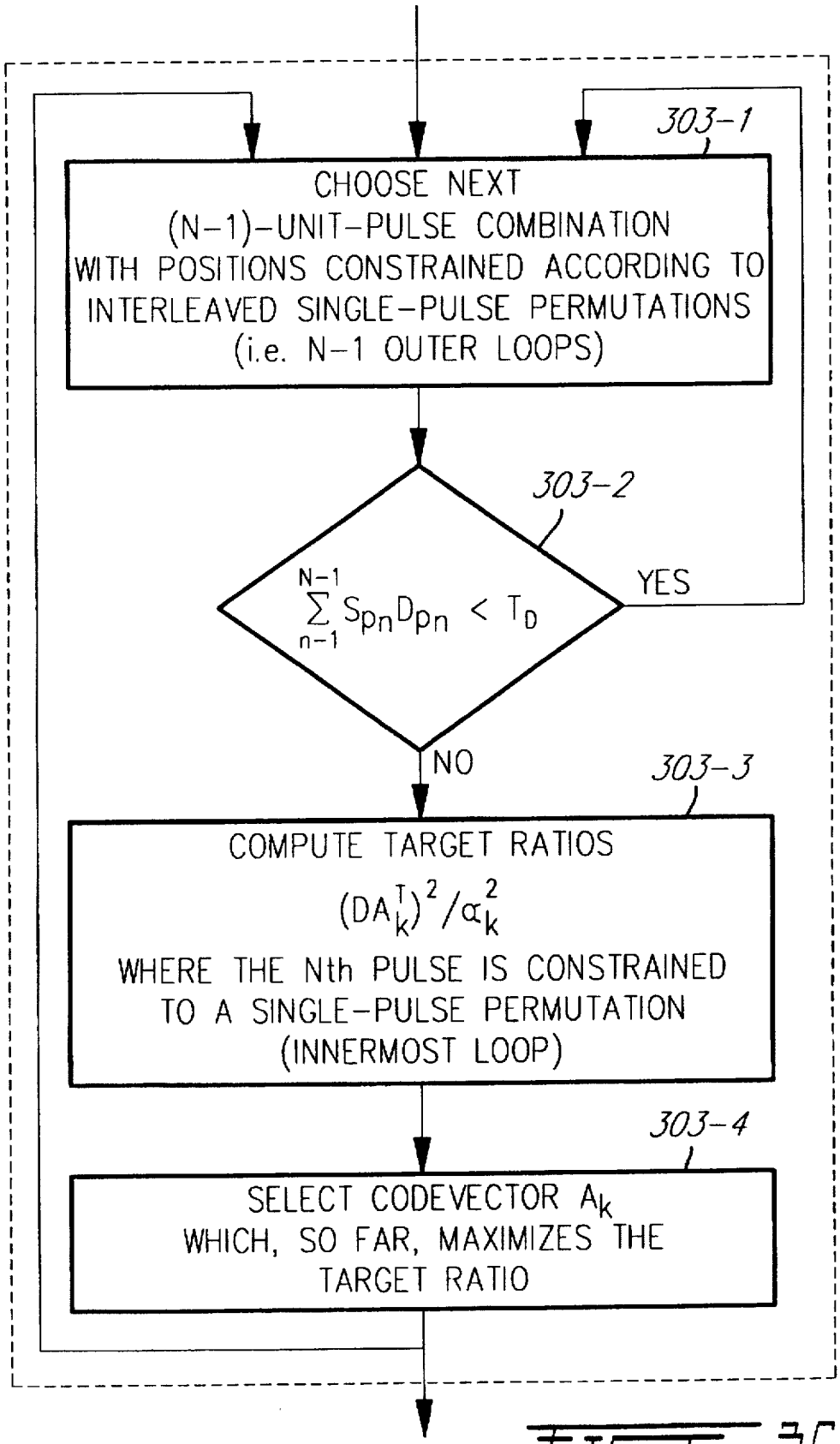
FIG. 3*c* is a sequence of operations involved in the N-embedded loop search in which the innermost loop is skipped whenever the contribution of the first N-1 pulses to the numerator $DA_k^T$ is deemed insufficient.

Referring now to FIG. 3*a*, 3*b* and 3*c*, the purpose of the amplitude selector 112 is to pre-establish a function $S_p$ between the positions p of the codevector waveform and the q possible values of the pulse amplitudes. The pre-established function $S_p$ is derived in relation to the speech signal prior to the codebook search. More specifically, pre-establishing this function consists of pre-assigning, in relation to the speech signal, at least one of the q possible amplitudes to each position p of the waveform (step 301 of FIG. 3*a*).

To pre-assign one of the q amplitudes to each position p of the waveform, an amplitude estimate vector B is calculated in response to the backward-filtered target vector D and to the pitch-removed residual vector R'. More specifically, the amplitude estimate vector B is calculated by summing (substep 301-1 of FIG. 3*b*) the backward-filtered target vector D in normalized form:

$$(1-\beta)\frac{D}{\|D\|}$$

and the pitch-removed residual vector R' in normalized form:

$$\beta\frac{R'}{\|R'\|}$$

to thereby obtain an amplitude estimate vector B of the form:

$$B = (1-\beta)\frac{D}{\|D\|} + \beta\frac{R'}{\|R'\|}$$

where β is a fixed constant having a typical value of ½ (the value of β is chosen between 0 and 1 depending on the percentage of non-zero-amplitude pulses used in the algebraic code).

For each position p of the waveform, the amplitude $S_p$ to be pre-assigned to that position p is obtained by quantizing a corresponding amplitude estimate $B_p$ of vector B. More specifically, for each position p of the waveform, a peak-normalized amplitude estimate $B_p$ of the vector B is quantized (substep 301-2 of FIG. 3*b*) using the following expression:

$$S_p = Q\left(B_p/\max_n|B_n|\right)$$

wherein Q (.) is the quantization function and $$\max_n|B_n|$$

is a normalisation factor representing a peak amplitude of the non-zero-amplitude pulses.

In the important special case in which:

- q=2, that is the pulse amplitudes can assume only two values (i.e. $S_{p_i}=\pm 1$); and

- the non-zero-amplitude pulse density N/L is lower than or equal to 15%;

the value of β can be equal to zero; then the amplitude estimate vector B reduces simply to the backward-filtered target vector D and consequently $S_{p=sign(Dp)}$.

The purpose of the optimizing controller 109 is to select the best codevector $A_k$ from the algebraic codebook. The selection criterion is given in the form of a ration to be calculated for each codevector $A_k$ and to be maximized over all codevectors (step 303)

$$\max_k \frac{(DA_k^T)^2}{\alpha_k^2}$$

where D=(XH) and $\alpha_k^2=\|A_kH^T\|^2$.

Since $A_k$ is an algebraic codevector having N non-zero-amplitude pulses of respective amplitudes $S_{p_i}$, the numerator is the square of $$DA_k^T \sum_{i=1}^{N} D_{p_i}S_{p_i}$$

and the denominator is an energy term which can be expressed as:

$$\alpha_k^2 = \sum_{i=1}^{N} S_{p_i}^2 U(p_i,p_i) + 2\sum_{i=1}^{N-1}\sum_{j=i+1}^{N} S_{p_i}S_{p_j}U(p_i,p_j)$$

where $U(p_i,p_j)$ is the correlation associated with two unit-amplitude pulses, one at position $p_i$ and the other at position $p_j$. This matrix is computed in accordance with the above equation in the filter response characterizer 105 and included in the set of parameters referred to as FRC in the block diagram of FIG. 1.

Figure 4:
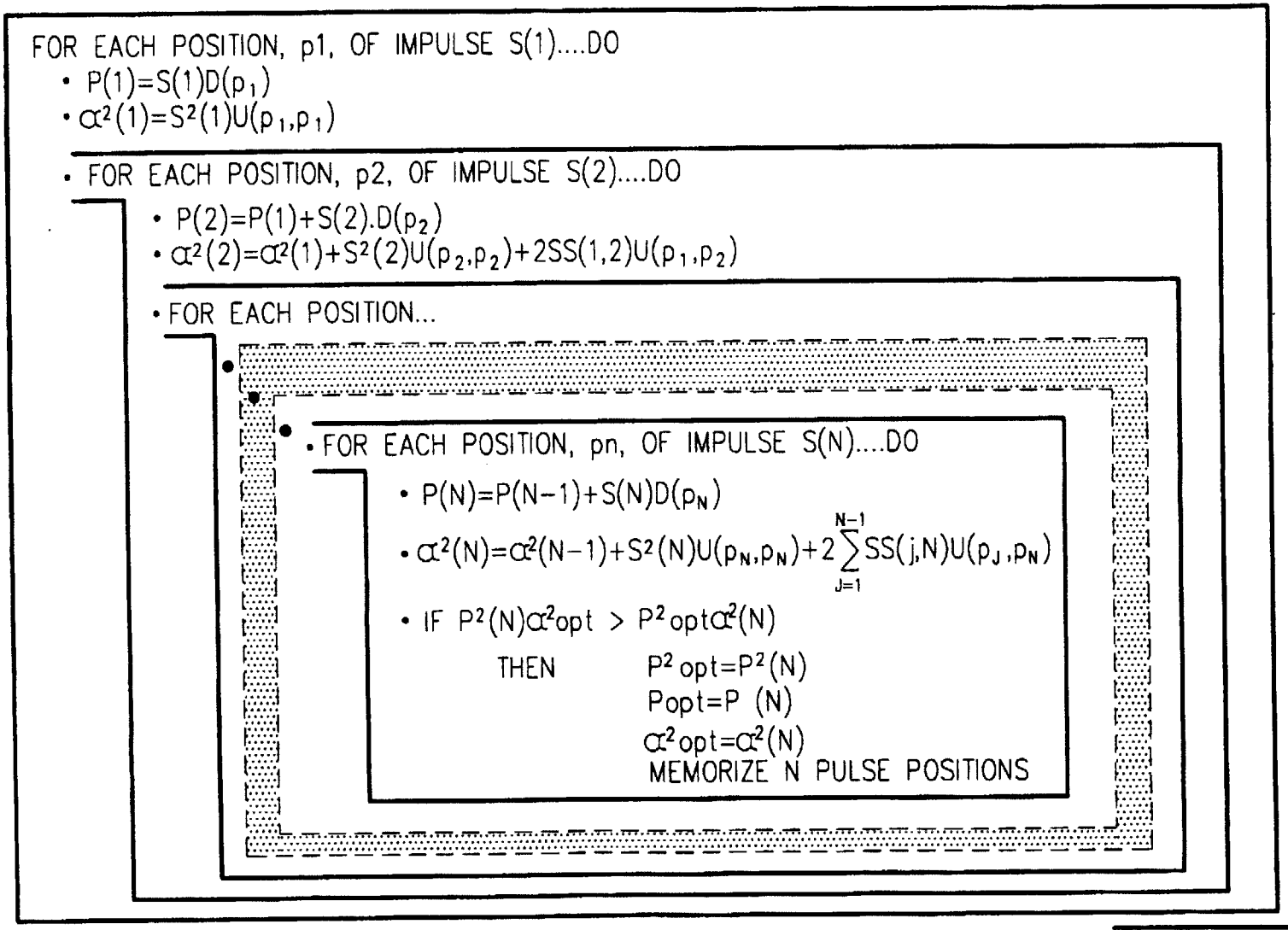
FIG. 4 is a schematic representation of the N-nested loops used in the codebook search.

A fast method for computing this denominator (step 304) involves the N-nested loops illustrated in FIG. 4 in which the trim lined notation S(i) and SS(i,j) is used in the place of the respective quantities "$S_{p_i}$" and "$S_{p_i}S_{p_j}$". Computation of the denominator $\alpha_k^2$ is the most time consuming process. The computations contributing to $\alpha_k^2$ which are performed in each loop of FIG. 4 can be written on separate lines from the outermost loop to the innermost loop as follows:

$$\begin{aligned}\alpha_k^2 = {} & S_{p_1}^2 U(p_1,p_1) + \\ & S_{p_2}^2 U(p_2,p_2) + 2S_{p_1}S_{p_2}U(p_1,p_2) + \\ & S_{p_3}^2 U(P_3,P_3) + 2[S_{p_1}S_{p_3}U(P_1,P_3) + S_{p_2}S_{p_3}U(P_2,P_3)] + \\ & \cdot \\ & \cdot \\ & \cdot \\ & S_{p_N}^2 U(p_N,P_N) + 2\,[S_{p_1}S_{p_N}U(p_1,p_N) + S_{p_2}S_{p_N}U(p_2,P_N) + \\ & \ldots + S_{p_{N-1}}S_{p_N}U(p_{N-1},p_N)]\end{aligned}$$

where $p_i$ is the position of the $i^{th}$ non-zero-amplitude pulse. Note that the N-nested loops of FIG. 4 enables constraining the non-zero-amplitude pulses of codevectors $A_k$ in accordance with N interleaved single-pulse permutation codes.

In the present invention search complexity is drastically reduced by restraining the subset of codevectors $A_k$ being searched to codevectors of which the N non-zero-amplitude pulses respect the function pre-established in step 301 of FIG. 3*a*. The pre-established function is respected when the N non-zero-amplitude pulses of a codevector $A_k$ each have an amplitude equal to the amplitude pre-assigned to the position p of the non-zero-amplitude pulse.

Said restraining the subset of codevectors is preformed by first combining the pre-established function $S_p$ with the entries of matrix U(i,j) (step 302 of FIG. 3*a*) then, by using the N-nested loops of FIG. 4 with all pulses S(i) assumed to be fixed, positive and of unit amplitude (step 303). Thus, even though the amplitude of non-zero pulses can take any of q possible values in the algebraic codebook, the search complexity is reduced to the case of fixed pulse amplitudes. More precisely, the matrix U(i,j) which is supplied by the filter response characterizer 105 is combined with the pre-established function in accordance with the following relation (step 302):

$$U'(i,j)=S_iS_jU(i,j)$$

where $S_i$ results from the selecting method of amplitude selector 112, namely $S_i$ is the amplitude selected for an individual position i following quantization of the corresponding amplitude estimate.

With this new matrix, the computation for each loop of the fast algorithm can be written on a separate line, from the outermost to the innermost loop, as follows:

$$\begin{aligned}\alpha_k^2 = {} & U'(p_1,p_1) + \\ & U'(p_2,p_2) + 2U'(p_1,p_1) + \\ & U'(p_3,p_3) + 2U'(p_1,p_3) + 2U'(p_2,p_3) + \\ & \cdot \\ & \cdot \\ & \cdot \\ & U'(p_N,p_N) + 2U'(p_1,p_N) + 2U'(p_2,p_N) + \ldots + 2U'(p\end{aligned}$$

where $p_x$ is the position of the $x^{th}$ non-zero-amplitude pulse of the waveform, and where $U'(p_x,p_y)$ is a function dependent on the amplitude $S_{p_x}$ pre-assigned to a position $p_x$ amongst the positions p and the amplitude $S_{p_y}$ pre-assigned to a position $p_y$ amongst the positions p.

To still further reduce the search complexity, one may skip (cf FIG. 3*c*) in particular, but not exclusively, the innermost loop whenever the following inequality is true:

$$\sum_{n=1}^{N-1} S_{p_n} D_{p_n} < T_D$$

where $S_{p_n}$ is the amplitude pre-assigned to position $p_n$, $D_{p_n}$ is the $p_n^{th}$ component of the target vector D, and $T_D$ is a threshold related to the backward-filtered target vector D.

The global signal excitation signal E+gCk is computed by an adder 120 (FIG. 1) from the signal gCk from the controller 109 and the output E from the predictor 106. The initial state extractor module 110, constituted by a perceptual filter with a transfer function $1/A(z\gamma^{-1})$ varying in relation to the STP parameters, subtracts from the residual signal R the signal excitation signal E+gCk for the sole purpose of obtaining the final filter state FS for use as initial state in filter 107 and pitch extractor 104.

The set of four parameters k, g, LTP and STP are converted into the proper digital channel format by a multiplexer 111 completing the procedure for encoding a block S of samples of speech signal.

Although the present invention has been described hereinabove with reference to preferred embodiments thereof, these embodiments can be modified at will, within the scope of the appended claims, without departing from the spirit and nature of the subject invention.

What is claimed is:

1. A method of conducting a search in a codebook in view of encoding a sound signal, said codebook consisting of a set of pulse amplitude/position combinations, each pulse amplitude/position combination defining L different positions and comprising both zero-amplitude pulses and non-zero-amplitude pulses assigned to respective positions p=1, 2, . . . L of the combination, and each non-zero-amplitude pulse assuming at least one of q possible amplitudes, said method comprising the steps of:

pre-selecting from said codebook a subset of pulse amplitude/position combinations in relation to the sound signal;

searching only said subset of pulse amplitude/position combinations in view of encoding the sound signal whereby complexity of the search is reduced as only a subset of the pulse amplitude/position combinations of the codebook is searched; and wherein the pre-selecting step comprises pre-establishing, in relation to the sound signal, a function $S_p$ pre-assigning to the positions p=1, 2, . . . L valid amplitudes out of said q possible amplitudes, and wherein the searching step comprises searching only the pulse amplitude/position combinations of said codebook having non-zero-amplitude pulses which respect the pre-established function.

2. The method of claim 1, wherein the function pre-establishing step comprises the step of pre-assigning, by means of the function $S_p$, one of the q possible amplitudes as valid amplitude to each position p, and wherein the pre-established function is respected when the non-zero-amplitude pulses of a pulse amplitude/position combination each have an amplitude equal to the amplitude pre-assigned by the function $S_p$ to the position p of said non-zero-amplitude pulse.

3. The method of claim 2, wherein the step of pre-assigning one of the q possible amplitudes to each position p comprises the steps of:

processing the sound signal to produce a backward-filtered target signal D and a pitch-removed residual signal R';

calculating an amplitude estimate vector B in response to the backward-filtered target signal D and to the pitch-removed residual signal R'; and for each of said positions p, quantizing an amplitude estimate $B_p$ of said vector B to obtain the amplitude to be selected for said position p.

4. The method of claim 3, in which the step of calculating an amplitude estimate vector B comprises the step of summing the backward-filtered target signal D in normalized form:

$$(1-\beta)\frac{D}{\|D\|}$$

to the pitch-removed residual signal R' in normalized form:

$$\beta\frac{R'}{\|R'\|}$$

to thereby obtain an amplitude estimate vector B of the form:

$$B=(1-\beta)\frac{D}{\|D\|}+\beta\frac{R'}{\|R'\|}$$

where β is a fixed constant.

5. The method of claim 4, wherein β is a fixed constant having a value situated between 0 and 1.

6. The method of claim 3, in which for each of said positions p, the quantizing step comprises quantizing a peak-normalized amplitude estimate $B_p$ of said vector B using the following expression:

$$B_p/\max_n |B_n|$$

wherein the denominator $$\max_n |B_n|$$

is a normalizing factor representing a peak amplitude of the non-zero-amplitude pulses.

7. The method of claim 3, wherein said pulse amplitude/position combinations each comprise a number N of non-zero-amplitude pulses, and wherein the searching step comprises the step of maximizing a given ratio having a denominator $\alpha_k^2$ computed by means of N nested loops in accordance with the following relation:

$$\begin{aligned}\alpha_k^2 = {} & U'(p_1,p_1)+\\ & U'(p_2,p_2)+2U'(p_1,p_1)+\\ & U'(p_3,p_3)+2U'(p_1,p_3)+2U'(p_2,p_3)+\\ & .\\ & .\\ & .\\ & U'(p_N,p_N)+2U'(p_1,p_N)+2U'(p_2,p_N)+\ldots+2U'(p_{N-1},p_N)\end{aligned}$$

where computation for each loop is written in a separate line from an outermost loop to an innermost loop of the N nested loops, where $p_n$ is the position of the $n^{th}$ non-zero-amplitude pulse of the combination, and where $U'(p_x, p_y)$ is a function dependent on the amplitude $S_{p_x}$ pre-assigned to a position $p_x$ amongst the positions p and the amplitude $S_{p_y}$ pre-assigned to a position $p_y$ amongst the positions p.

8. The method of claim 7, wherein the step of maximizing said given ratio comprises the step of skipping at least the innermost loop of the N nested loops whenever the following inequality is true where $S_{p_n}$ is the amplitude pre-assigned to position $p_n$, $D_{p_n}$ is the $p_n^{th}$ component of the target signal D, and $T_D$ is a threshold related to the backward-filtered target signal D.

9. The method of claim 1, wherein said pulse amplitude/position combinations each comprise a number N of non-zero-amplitude pulses, said method further comprising the step of restraining the positions p of the non-zero-amplitude pulses in accordance with at least one N-interleaved single-pulse permutation code.

10. A device for conducting a search in a codebook in view of encoding a sound signal, said codebook consisting of a set of pulse amplitude/position combinations, each pulse amplitude/position combination defining L different positions and comprising both zero-amplitude pulses and non-zero-amplitude pulses assigned to respective positions p=1, 2, . . . L of the combination, and each non-zero-amplitude pulse assuming at least one of q possible amplitudes, said device comprising:

means for pre-selecting from said codebook a subset of pulse amplitude/position combinations in relation to the sound signal; and means for searching only said subset of pulse amplitude/position combinations in view of encoding the sound signal whereby complexity of the search is reduced as only a subset of the pulse amplitude/position combinations of the codebook is searched;

wherein the pre-selecting means comprises means for pre-establishing, in relation to the sound signal, a function $S_p$ pre-assigning to the positions p=1, 2, . . . L valid amplitudes out of said q possible amplitudes, and wherein the searching means comprises means for limiting the search to the pulse amplitude/position combinations of said codebook having non-zero-amplitude pulses which respect the pre-established function.

11. The device of claim 10, wherein the function pre-establishing means comprises means for pre-assigning, by means of the function $S_p$, one of the q possible amplitudes as valid amplitude to each position p, and wherein the pre-established function is respected when the non-zero-amplitude pulses of a pulse amplitude/position combination each have an amplitude equal to the amplitude pre-assigned by the function $S_p$ to the position p of said non-zero-amplitude pulse.

12. The device of claim 11, wherein the means for pre-assigning one of the q possible amplitudes to each position p comprises:

means for processing the sound signal to produce a backward-filtered target signal D and a pitch-removed residual signal R';

means for calculating an amplitude estimate vector B in response to the backward-filtered target signal D and to the pitch-removed residual signal R'; and means for quantizing, for each of said positions p, an amplitude estimate $B_p$ of said vector B to obtain the amplitude to be selected for said position p.

13. The device of claim 12, in which said means for calculating an amplitude estimate vector B comprises means for summing the backward-filtered target signal D in normalized form:

$$(1-\beta)\frac{D}{\|D\|}$$

to the pitch-removed residual signal R' in normalized form:

$$\beta\frac{R'}{\|R'\|}$$

to thereby obtain an amplitude estimate vector B of the form:

$$B=(1-\beta)\frac{D}{\|D\|}+\beta\frac{R'}{\|R'\|}$$

where β is a fixed constant.

14. The device of claim 13, wherein β is a fixed constant having a value situated between 0 and 1.

15. The device of claim 12, in which said quantizing means comprises means for quantizing, for each of said positions p, a peak-normalized amplitude estimate $B_p$ of said vector B using the following expression:

$$B_p/\max_n |B_n|$$

wherein the denominator $$\max_n |B_n|$$

is a normalizing factor representing a peak amplitude of the non-zero-amplitude pulses.

16. The device of claim 12, wherein said pulse amplitude/position combinations each comprise a number N of non-zero-amplitude pulses, and wherein the searching means comprises means for maximizing a given ratio having a denominator $\alpha_k^2$ and means for computing said denominator $\alpha_k^2$ by means of N nested loops in accordance with the following relation:

$$\begin{aligned}\alpha_k^2 = {} & U'(p_1,p_1)+\\ & U'(p_2,p_2)+2U'(p_1,p_1)+\\ & U'(p_3,p_3)+2U'(p_1,p_3)+2U'(p_2,p_3)+\\ & \cdot\\ & \cdot\\ & \cdot\\ & U'(p_N,p_N)+2U'(p_1,p_N)+2U'(p_2,p_N)+\ldots+2U'(p_{N-1},p_N)\end{aligned}$$

where computation for each loop is written in a separate line from an outermost loop to an innermost loop of the N nested loops, where $p_n$ is the position of the $n^{th}$ non-zero-amplitude pulse of the combination, and where $U'(p_x,p_y)$ is a function dependent on the amplitude $S_{p_x}$ pre-assigned to a position $p_x$ amongst the positions p and the amplitude $S_{p_y}$, pre-assigned to a position $p_y$ amongst the positions p.

17. The device of claim 16, wherein said means for computing the denominator $\propto_k^2$ comprises means for skipping at least the innermost loop of the N nested loops whenever the following inequality is true where $S_{p_n}$ is the amplitude pre-assigned to position $p_n$, $D_{p_n}$ is the $p_n^{th}$ component of the target signal D, and $T_D$ is a threshold related to the backward-filtered target signal D.

18. The device of claim 10, wherein said pulse amplitude/position combinations each comprise a number N of non-zero-amplitude pulses, said device further comprising means for restraining the positions p of the non-zero-amplitude pulses in accordance with at least one N-interleaved single-pulse permutation code.

19. A cellular communication system for servicing a large geographical area divided into a plurality of cells, comprising:

mobile transmitter/receiver units;

cellular base stations respectively situated in said cells;

means for controlling communication between the cellular base stations;

a bidirectional wireless communication sub-system between each mobile unit situated in one cell and the cellular base station of said one cell, said bidirectional wireless communication sub-system comprising in both the mobile unit and the cellular base station (a) a transmitter including means for encoding a speech signal and means for transmitting the encoded speech signal, and (b) a receiver including means for receiving a transmitted encoded speech signal and means for decoding the received encoded speech signal;

wherein said speech signal encoding means comprises a device for conducting a search in a codebook in view of encoding the speech signal, said codebook consisting of a set of pulse amplitude/position combinations, each pulse amplitude/position combination defining L different positions and comprising both zero-amplitude pulses and non-zero-amplitude pulses assigned to respective positions p=1, 2, . . . L of the combination, and each non-zero-amplitude pulse assuming at least one of q possible amplitudes, said search conducting device comprising:

means for pre-selecting from said codebook a subset of pulse amplitude/position combinations in relation to the speech signal; and means for searching only said subset of pulse amplitude/position combinations in view of encoding the speech signal whereby complexity of the search is reduced as only a subset of the pulse amplitude/position combinations of the codebook is searched;

wherein the pre-selecting means comprises means for pre-establishing, in relation to the sound signal, a function $S_p$ pre-assigning to the positions p=1, 2, . . . L valid amplitudes out of said q possible amplitudes, and wherein the searching means comprises means for limiting the search to the pulse amplitude/position combinations of said codebook having non-zero-amplitude pulses which respect the pre-established function.

20. The system of claim 19, wherein the function pre-establishing means comprises means for pre-assigning, by means of the function $S_p$, one of the q possible amplitudes as valid amplitude to each position p, and wherein the pre-established function is respected when the non-zero-amplitude pulses of a pulse amplitude/position combination each have an amplitude equal to the amplitude pre-assigned by the function $S_p$ to the position p of said non-zero-amplitude pulse.

21. The system of claim 20, wherein the means for pre-assigning one of the q possible amplitudes to each position p comprises:

means for processing the speech signal to produce a backward-filtered target signal D and a pitch-removed residual signal R';

means for calculating an amplitude estimate vector B in response to the backward-filtered target signal D and to the pitch-removed residual signal R'; and means for quantizing, for each of said positions p, an amplitude estimate $B_p$ of said vector B to obtain the amplitude to be selected for said position p.

22. The system of claim 21, in which said means for calculating an amplitude estimate vector B comprises means for summing the backward-filtered target signal D in normalized form:

$$(1-\beta)\frac{D}{\|D\|}$$

to the pitch-removed residual signal R' in normalized form:

$$\beta\frac{R'}{\|R'\|}$$

to thereby obtain an amplitude estimate vector B of the form:

$$B=(1-\beta)\frac{D}{\|D\|}+\beta\frac{R'}{\|R'\|}$$

where β is a fixed constant.

23. The system of claim 22, wherein β is a fixed constant having a value situated between 0 and 1.

24. The system of claim 21, in which said quantizing means comprises means for quantizing, for each of said positions p, a peak-normalized amplitude estimate $B_p$ of said vector B using the following expression:

$$B_p/\max_n |B_n|$$

wherein the denominator $$\max_n |B_n|$$

is a normalizing factor representing a peak amplitude of the non-zero-amplitude pulses.

25. The system of claim 21, wherein said pulse amplitude/position combinations each comprise a number N of non-zero-amplitude pulses, and wherein the searching means comprises means for maximizing a given ratio having a denominator $\alpha_k^2$ and means for computing said denominator $\alpha_k^2$ by means of N nested loops in accordance with the following relation:

$$\begin{aligned}\alpha_k^2 = {} & U'(p_1,p_1)+\\ & U'(p_2,p_2)+2U'(p_1,p_1)+\\ & U'(p_3,p_3)+2U'(p_1,p_3)+2U'(p_2,p_3)+\\ & \cdot\\ & \cdot\\ & \cdot\\ & U'(p_N,p_N)+2U'(p_1,p_N)+2U'(p_2,p_N)+\ \ldots+2U'(p_{N-1},p_N)\end{aligned}$$

where computation for each loop is written in a separate line from an outermost loop to an innermost loop of the N nested loops, where $p_n$ is the position of the $n^{th}$ non-zero-amplitude pulse of the combination, and where $U'(p_x, p_y)$ is a function dependent on the amplitude $S_{p_x}$ pre-assigned to a position $p_x$ amongst the positions p and the amplitude $S_{p_y}$ pre-assigned to a position $p_y$ amongst the positions p.

26. The system of claim 25, wherein said means for computing the denominator $\propto_k^2$ comprises means for skipping at least the innermost loop of the N nested loops whenever the following inequality is true where $S_{p_n}$ is the amplitude pre-assigned to position $p_n$, $D_{p_n}$ is the $p_n^{th}$ component of the target signal D, and $T_D$ is a threshold related to the backward-filtered target signal D.

27. The system of claim 19, wherein said pulse amplitude/position combinations each comprise a number N of non-zero-amplitude pulses, said device further comprising means for restraining the positions p of the non-zero-amplitude pulses in accordance with at least one N-interleaved single-pulse permutation code.

* * * * *

US005754976C1

(12) EX PARTE REEXAMINATION CERTIFICATE (5665th)

United States Patent

Adoul et al.

(10) Number: US 5,754,976 C1

(45) Certificate Issued: Jan. 30, 2007

(54) ALGEBRAIC CODEBOOK WITH SIGNAL SELECTED PULSE AMPLITUDE/POSITION COMBINATIONS FOR FAST CODING OF SPEECH

(75) Inventors: Jean-Pierre Adoul, Sherbrooke (CA); Claude Laflamme, Sherbrooke (CA)

(73) Assignee: Universite de Sherbrooke, Sherbrooke (CA)

Reexamination Request:
No. 90/007,201, Sep. 13, 2004

Reexamination Certificate for:

| | |
|---|---|
| Patent No.: | **5,754,976** |
| Issued: | **May 19, 1998** |
| Appl. No.: | **08/508,801** |
| Filed: | **Jul. 28, 1995** |

Related U.S. Application Data

(63) Continuation-in-part of application No. 08/383,968, filed on Feb. 6, 1995, now abandoned, which is a continuation-in-part of application No. 07/927,528, filed as application No. PCT/CA90/00381 on Nov. 6, 1990, now Pat. No. 5,444,816.

(30) Foreign Application Priority Data

Feb. 23, 1990 (CA) ..... 2010830

(51) Int. Cl.
*G10L 19/12* (2006.01)

(52) U.S. Cl. ..... 704/223; 704/219; 704/230; 704/262

(58) Field of Classification Search ..... 704/223, 704/219, 230, 262, 220
See application file for complete search history.

(56) References Cited

U.S. PATENT DOCUMENTS 4,932,061 A 6/1990 Kroon 5,729,654 A 3/1998 Miller et al.

FOREIGN PATENT DOCUMENTS

| | | |
|---|---|---|
| EP | 0396121 B1 | 9/1996 |
| EP | 0813736 B1 | 5/2000 |
| EP | 0808496 B1 | 1/2003 |
| JP | 1319799 | 12/1989 |
| JP | 5100697 | 4/1993 |
| WO | WO 8902147 A1 | 3/1989 |
| WO | 91/13432 | 9/1991 |

OTHER PUBLICATIONS

R. Salami et al., A Toll Quality 8kb/s Speech Frame: A Candidate for CCITT Standardisation, IEEE Transaction on Vehicular Technology, vol. 43, No. 3, Aug. 1994, pp. 808–816.

(Continued)

*Primary Examiner*—Vijay Chawan

(57) ABSTRACT

A codebook is searched in view of encoding a sound signal. This codebook consists of a set of pulse amplitude/position combinations each defining L different positions and comprising both zero-amplitude pulses and non-zero-amplitude pulses assigned to respective positions p=1,2, . . . L of the combination, wherein each non-zero amplitude pulse assumes at least one of q possible amplitudes. To reduce the search complexity, a subset of pulse amplitude/position combinations from the codebook is pre-selected in relation to the sound signal, and only this subset of combinations is searched. The pre-selection of the subset of combinations consists of pre-establishing, in relation to the sound signal, a function $S_p$ between the respective positions p=1, 2, . . . L and the q possible amplitudes, the search being limited to the combinations of the codebook having non-zero-amplitude pulses which respect the pre-established function. The function can be pre-established by pre-assigning one of the q possible amplitudes to each position p, the pre-established function being respected when the non-zero amplitude pulses of a combination each have an amplitude equal to the amplitude $S_p$ pre-assigned to the position p of that pulse.

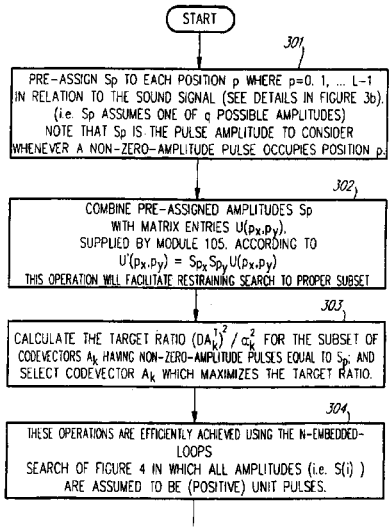

OTHER PUBLICATIONS

R. Salami et al., 8Kbits/s ACELP Coding of Speech with 10 ms Speech Frame: A Candidate for CCITT Standardisation, IEEE, 1994, pp. II–97 to II–100.

R. Salami et al., "A Robust Transformed Binary Vector Excited Coder with Embedded Error–Correction Coding," IEE Colloquium on Speech Coding (Digest No. 112), 1989, pp. 5/1–5/6.

Salami, "Robust Bit Rate Analysis–By–Synthesis Predictive Speech Coding," Ph.D Thesis, May 1990, University of Southampton, UK.

Salami et al., "Real–Time Implementation of a 9.6 Kbit/s ACELP Wideband Speech Coder," IEEE Global Telecomm. Conf., Orlando, FL. Dec. 6–9, 1992, vol. 1, pp. 447–451.

Iai et al., "8 kbit/s Speech Coder with Pitch Adaptive Vector Quantizer," Proc. Int'l Conf. Acoust., Speech, & Signal Processing (ICASSP), Apr. 7–11, 1986, pp. 1697–1700.

Berouti et al., "Efficient Computation and Encoding of the Multipulse Excitation for LPC," Proc. ICASSP, Mar. 1984, pp. 10.1.1–10.1.4.

Freeman et al., "A reduced complexity CELP scheme," IEE Colloquium on "Speech Processing," Jan. 19, 1988, pp. 8/1–8/3.

Salami et al., "Performance of error protected binary pulse excitation coders at 11.4 kb/s over mobile radio channels," Proc. ICASSP, Apr. 1990, pp. 473–476.

Salami, "Binary Pulse Excitation: A Novel Approach To Low Complexity CELP Coding," in Atal et al, eds., Advances In Speech Coding, 1991, pp. 145–156.

Salami et al, "Chapter 3: Speech Coding," in Steele, ed., Mobile Radio Communications, 1992, pp. 186–346.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–27 is confirmed.

New claims 28–34 are added and determined to be patentable.

*28. The method of claim 2, wherein the step of pre-assigning one of the q possible amplitudes to each position p comprises the steps of:*

*processing the sound signal to produce a backward-filtered target signal D;*

*calculating an amplitude estimate vector B in response to the backward-filtered target signal D; and*

*for each said position p, quantizing an amplitude estimate $B_p$ of said vector to obtain the amplitude to be selected for each said position p.*

*29. A method of conducting a search in a codebook in view of encoding a sound signal, said codebook consisting of a set of pulse amplitude/position combinations, each pulse amplitude/position combination defining L different positions and comprising both zero-amplitude pulses and non-zero-amplitude pulses assigned to respective positions p=1, 2, . . . L of the combination, and each non-zero-amplitude pulse assuming at least one of q possible amplitudes, said method comprising the steps of:*

*pre-selecting form said codebook a subset of pulse amplitude/position combinations in relation to the sound signal;*

*searching only said subset of pulse amplitude/position combinations in view of encoding the sound signal whereby complexity of the search is reduced as only a subset of the pulse amplitude/position combinations of the codebook is searched;*

*wherein the pre-selecting step comprises pre-establishing, in relation to the sound signal, a function $S_p$ pre-assigning to the positions p =1, 2, . . . L valid amplitudes out of said q possible amplitudes, and wherein the searching step comprises searching only the pulse amplitude/position combinations of said codebook having non-zero-amplitude pulses which respect the pre-established function;*

*wherein the positions p of the non-zero-amplitude pulses of the pulse amplitude/position combinations of said codebook are restrained in accordance with a set of tracks of pulse positions.*

*30. The method of claim 29, wherein the pulse positions of each track are interleaved with the pulse positions of the other tracks.*

*31. The method of claim 29, wherein:*

*said pulse amplitude/position combinations of said codebook each comprise a number N of non-zero-*amplitude pulses;

*the set of tracks comprises N tracks of pulse positions respectively associated to the N non-zero-amplitude pulses;*

*the pulse positions of each track are interleaved with the pulse positions of the N–1 other tracks; and*

*the pulse positions of each non-zero-amplitude pulse are restrained to the positions of the associated track.*

*32. A method of conducting a search in a codebook in view of encoding a sound signal, said codebook consisting of a set of pulse amplitude/position combinations, each pulse amplitude/position combination defining L different positions and comprising both zero-amplitude pulses and non-zero-amplitude pulses assigned to respective positions p=1, 2, . . . L of the combination, and each non-zero-amplitude pulse assuming at least one of the q possible amplitudes, said method comprising the steps of:*

*pre-selecting from said codebook a subset of pulse amplitude/position combinations in relation to the sound signal;*

*searching only said subset of pulse amplitude/position combinations in view of encoding the sound signal whereby complexity of the search is reduced as only a subset of the pulse amplitude/position combinations of the codebook is searched; and*

*wherein the pre-selecting step comprises pre-establishing, in relation to the sound signal, pre-assigning, by means of the function $S_p$, one of q possible amplitudes as valid amplitude to each of the positions p=1, 2, . . . L, and wherein the searching step comprises searching only the pulse amplitude/position combinations of said codebook having non-zero-amplitude pulses which respect the pre-established function, and wherein the pre-established function is respected when the non-zero-amplitude pulses of a pulse amplitude/position combination each have an amplitude equal to the amplitude pre-assigned by the function $S_p$ to the position p of said non-zero-amplitude pulse;*

*wherein the positions p of the non-zero-amplitude pulses of the pulse amplitude/position combinations of said codebook are restrained in accordance with a set of tracks of pulse positions; and*

*wherein the step of pre-assigning one of the q possible amplitudes to each position p further comprises the steps of:*

*processing the sound signal to produce a backward-filtered target signal D;*

*calculating an amplitude estimate vector B in response to the backward-filtered target signal D; and*

*for each said position p, quantizing an amplitude estimate $B_p$ of said vector B to obtain the amplitude to be selected for each said position p.*

*33. The method of claim 32, wherein the pulse positions of each track are interleaved with the pulse positions of the other tracks.*

*34. The method of claim 32, wherein:*

*said combinations of the codebook each comprise a number N of non-zero-*amplitude pulses;

*the set of tracks comprises N tracks of pulse positions respectively associated to the N non-zero-amplitude pulses;*

*the pulse positions of each track are interleaved with the pulse positions of the N—1 other tracks; and*

*the pulse positions of each non-zero-amplitude pulse are restrained to the positions of the associated track.*

* * * * *